US009169815B2

(12) United States Patent
Akita et al.

(10) Patent No.: US 9,169,815 B2
(45) Date of Patent: Oct. 27, 2015

(54) HIGH-PRESSURE FUEL SUPPLY APPARATUS FOR INTERNAL COMBUSTION ENGINE

(75) Inventors: Tatsuhiko Akita, Okazaki (JP); Mitsuto Sakai, Toyota (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 1196 days.

(21) Appl. No.: 12/743,056

(22) PCT Filed: Nov. 14, 2008

(86) PCT No.: PCT/IB2008/003062
§ 371 (c)(1),
(2), (4) Date: May 14, 2010

(87) PCT Pub. No.: WO2009/063306
PCT Pub. Date: May 22, 2009

(65) Prior Publication Data

US 2011/0114064 A1 May 19, 2011

(30) Foreign Application Priority Data

Nov. 16, 2007 (JP) ..... 2007-298068

(51) Int. Cl.
*F02M 37/00* (2006.01)
*F02M 59/46* (2006.01)
*F02M 63/02* (2006.01)
(Continued)

(52) U.S. Cl.
CPC ..... *F02M 59/462* (2013.01); *F02M 37/0052* (2013.01); *F02M 37/0058* (2013.01); *F02M 55/002* (2013.01); *F02M 55/007* (2013.01); *F02M 55/02* (2013.01);
(Continued)

(58) Field of Classification Search
CPC ..... F02M 63/0245; F02M 37/0052; F02M 37/0058
USPC ..... 123/495, 447, 457, 463; 137/493.1–493.9
See application file for complete search history.

(56) References Cited

U.S. PATENT DOCUMENTS 3,896,845 A * 7/1975 Parker ..... 137/493.3
3,976,096 A * 8/1976 Kass et al. ..... 137/493.2
(Continued)

FOREIGN PATENT DOCUMENTS

EP 1 707 799 A1 10/2006
EP 1 788 231 A1 5/2007
(Continued)

*Primary Examiner* — Mahmoud Gimie
*Assistant Examiner* — David Hamaoui
(74) *Attorney, Agent, or Firm* — Sughrue Mion, PLLC

(57) ABSTRACT

A discharge valve (30) is provided in a high-pressure fuel passage (31) to allow fuel to pass through the discharge valve (30) only in a direction from a high-pressure fuel pump (20) toward a delivery pipe (50). A communication passage (41) with an orifice (42) is formed integrally with the discharge valve (30) in parallel with the discharge valve (30) to connect areas upstream and downstream of the discharge valve (30). When a fuel pressure in the delivery pipe (50) is increased to a target pressure using the high-pressure fuel pump (20), an amount of the fuel, which does not interfere with an increase in the fuel pressure, flows through the orifice (42). A check valve (40) is provided in the communication passage (41), and opened to allow the fuel to pass through the check valve (40) only in the direction from the delivery pipe (50) toward the high-pressure fuel pump (20), when the fuel pressure is higher than a first predetermined pressure.

3 Claims, 5 Drawing Sheets

(51) Int. Cl.
*F02M 55/00* (2006.01)
*F02M 55/02* (2006.01)

(52) U.S. Cl.
CPC ..... *F02M 63/0225* (2013.01); *F02M 63/0245* (2013.01); *F02M 2200/18* (2013.01); *F02M 2200/28* (2013.01)

(56) References Cited

U.S. PATENT DOCUMENTS

| | | | | | |
|---|---|---|---|---|---|
| 4,520,774 | A * | 6/1985 | Sitter | 123/300 |
| 4,648,369 | A * | 3/1987 | Wannenwetsch | 123/467 |
| 4,834,134 | A * | 5/1989 | Asami et al. | 137/493.3 |
| 5,015,160 | A * | 5/1991 | Hlousek et al. | 417/499 |
| 5,339,785 | A * | 8/1994 | Wilksch | 123/457 |
| 5,477,829 | A * | 12/1995 | Hassinger et al. | 123/467 |
| 5,582,202 | A * | 12/1996 | Schultz et al. | 137/493.3 |
| 6,058,912 | A * | 5/2000 | Rembold et al. | 123/516 |
| 6,067,964 | A * | 5/2000 | Ruoff et al. | 123/467 |
| 6,305,413 | B1 * | 10/2001 | Fischer et al. | 137/493.8 |
| 6,352,067 | B1 * | 3/2002 | Genslak | 123/510 |
| 6,718,947 | B1 * | 4/2004 | Mahr et al. | 123/447 |
| 6,837,219 | B2 * | 1/2005 | York et al. | 123/457 |
| 6,988,488 | B2 * | 1/2006 | Pursifull et al. | 123/467 |
| 7,086,388 | B2 * | 8/2006 | Roth et al. | 123/510 |
| 7,267,108 | B2 * | 9/2007 | Barylski et al. | 123/457 |
| 7,603,987 | B2 * | 10/2009 | Koivunen et al. | 123/495 |
| 8,091,583 | B2 * | 1/2012 | Olshanetsky et al. | 137/493.2 |
| 8,132,558 | B2 * | 3/2012 | Lucas et al. | 123/510 |
| 8,297,941 | B2 * | 10/2012 | Suzuki et al. | 417/307 |
| 2004/0250795 | A1 * | 12/2004 | Stroia et al. | 123/447 |
| 2006/0000448 | A1 * | 1/2006 | Ricco et al. | 123/447 |

FOREIGN PATENT DOCUMENTS

| | | | |
|---|---|---|---|
| GB | 1 216 682 | A | 12/1970 |
| JP | 57-153767 | U | 3/1981 |
| JP | 60-247049 | U | 12/1985 |
| JP | 62-162376 | U | 10/1987 |
| JP | 1-144466 | U | 10/1989 |
| JP | 1-152061 | U | 10/1989 |
| JP | 6-33848 | A | 2/1994 |
| JP | 8-114160 | A | 5/1996 |
| JP | 9-88763 | A | 3/1997 |
| JP | 10-2265 | A | 1/1998 |
| JP | 2000-329032 | A | 11/2000 |
| JP | 2001-214828 | A | 8/2001 |
| JP | 2006-90222 | A | 4/2006 |
| WO | 2004/061293 | A1 | 7/2004 |
| WO | 2007/122127 | A1 | 11/2007 |

* cited by examiner

HIGH-PRESSURE FUEL SUPPLY APPARATUS FOR INTERNAL COMBUSTION ENGINE

BACKGROUND OF THE INVENTION

1. Field of the Invention

The invention relates to a high-pressure fuel supply apparatus for an internal combustion engine.

2. Description of the Related Art

For example, in a fuel system for an in-cylinder injection internal combustion engine, a high-pressure fuel pump, which increases a pressure of fuel, is employed to inject the fuel directly into a cylinder. In the fuel system, the fuel supplied from a fuel tank by a low-pressure fuel pump is pressurized by the high-pressure fuel pump so that the fuel is delivered under pressure to a fuel injection valve through a high-pressure fuel passage and a delivery pipe. A fuel pressure in the delivery pipe is adjusted, and maintained at a predetermined high pressure by, for example, a high-pressure regulator.

In the configuration in which the pressure in the delivery pipe is maintained at a high pressure, after the engine is stopped, the pressure in the delivery pipe may not be decreased, that is, the pressure in the delivery pipe may be maintained at a high pressure. Therefore, the fuel may leak from the fuel injection valve. The fuel that leaks from the fuel injection valve is accumulated in the cylinder, and the accumulated fuel, which remains unburned, is discharged when the engine is started next time. This may result in deterioration of emissions at an engine start time. For example, Japanese Patent Application Publication No. 2006-90222 describes a configuration in which a discharge valve with a leak function is provided between the high-pressure fuel pump and the delivery pipe to suppress the leakage of the fuel. The discharge valve with the leak function is provided in the high-pressure fuel passage. The discharge valve allows the fuel to pass through the discharge valve only in the direction from the high-pressure fuel pump toward the delivery pipe. Pores, which are constantly open, are provided in the discharge valve. In the configuration, when the engine is stopped while the pressure at the side where the delivery pipe is provided is higher than the pressure at the side where the high-pressure fuel pump is provided, the high-pressure fuel at the side where the delivery pipe is provided is returned toward the high-pressure fuel pump through the pores. As a result, the fuel pressure in the delivery pipe is decreased. Thus, it is possible to suppress the leakage of the fuel.

The fuel is returned toward the high-pressure fuel pump through the discharge valve with the leak function described in the publication No. 2006-90222, until the pressure at the side where the delivery pipe is provided is equal to the pressure at the side where the high-pressure fuel pump is provided. Therefore, it is difficult to appropriately adjust the pressure at the side where the delivery pipe is provided.

If the pressure in the delivery pipe decreases after the engine is stopped, a temperature at which the fuel is vaporized (i.e., a vaporization temperature) also decreases. Further, the temperature of the fuel in the delivery pipe increases because a temperature in an engine room increases, for example, due to stop of an engine cooling system. As a result, the temperature of the fuel in the delivery pipe may exceed the vaporization temperature at which the fuel is vaporized. Thus, vapor (bubbles) may be generated in the delivery pipe. That is, in the configuration described in the publication No. 2006-90222, although the leakage of the fuel from the fuel injection valve is suppressed, the vapor may be generated in the delivery pipe. If the vapor is generated in the delivery pipe, the vapor is retained in the delivery pipe, or discharged from the fuel injection valve together with the fuel. This may result in deterioration of startability of the internal combustion engine.

SUMMARY OF THE INVENTION

The invention provides a high-pressure fuel supply apparatus for an internal combustion engine, which suppresses leakage of fuel from a fuel injection valve, and generation of vapor.

A first aspect of the invention relates to a high-pressure fuel supply apparatus for an internal combustion engine. The high-pressure fuel supply apparatus includes: a high-pressure fuel pump that pressurizes fuel; a delivery pipe to which the fuel pressurized by the high-pressure fuel pump is delivered through a high-pressure fuel passage, and in which the fuel is stored, wherein the fuel stored in the delivery pipe is supplied to a cylinder by a fuel injection valve; a communication passage connected to the delivery pipe, wherein when a fuel pressure in the delivery pipe is increased to a target pressure using the high-pressure fuel pump, an amount of the fuel, which does not interfere with an increase in the fuel pressure in the delivery pipe, flows through the communication passage; and a check valve provided in the communication passage, wherein when the fuel pressure in the delivery pipe is higher than a first predetermined pressure, the check valve is opened to allow only the fuel that flows out from the delivery pipe to pass through the check valve. The first predetermined pressure is set to a value at which an amount of vapor generated in the delivery pipe after the internal combustion engine is stopped is equal to or smaller than a first permissible value, and an amount of the fuel that leaks from the fuel injection valve is equal to or smaller than a second permissible value.

With the above-described configuration, it is possible to increase the fuel pressure in the delivery pipe to the target pressure. Also, because the fuel is not delivered under pressure toward the delivery pipe when the high-pressure fuel pump is not operated, it is possible to decrease the fuel pressure in the delivery pipe by allowing the fuel to flow out from the delivery pipe through the communication passage.

Also, with the above-described configuration, it is possible to maintain the fuel pressure in the delivery pipe at the first predetermined pressure. Therefore, it is possible to suppress the leakage of the fuel from the fuel injection valve and the generation of the vapor. Accordingly, it is possible to suppress the deterioration of emissions at the engine start time due to the leakage of the fuel, and to suppress the deterioration of startability due to the generation of the vapor.

The high-pressure fuel supply apparatus may further include a discharge valve that is provided in the high-pressure fuel passage, and that allows the fuel to pass through the discharge valve only in a direction from the high-pressure fuel pump toward the delivery pipe. The communication passage may be provided in parallel with the discharge valve, and the communication passage may connect an area upstream of the discharge valve to an area downstream of the discharge valve. When the fuel pressure in the delivery pipe is higher than the first predetermined pressure, the check valve may be opened to allow the fuel to flow only in the direction from the delivery pipe toward the high-pressure fuel pump.

With the above-described configuration, it is possible to increase the fuel pressure in the delivery pipe to the target pressure. Also, because the fuel is not delivered under pressure toward the delivery pipe when the high-pressure fuel pump is not operated, it is possible to decrease the fuel pressure in the delivery pipe by returning the fuel in the direction from the delivery pipe toward the high-pressure fuel pump through the communication passage.

Also, with the above-described configuration, it is possible to maintain the fuel pressure in the delivery pipe at the first predetermined pressure. Therefore, it is possible to suppress the leakage of the fuel from the fuel injection valve and the generation of the vapor. Accordingly, it is possible to suppress deterioration of emissions at an engine start time due to the leakage of the fuel, and to suppress deterioration of startability due to the generation of the vapor.

The amount of the fuel returned toward the high-pressure fuel pump through the communication passage depends on the cross sectional area of the communication passage. Accordingly, the cross sectional area of the communication passage, or the cross sectional area of the orifice provided in the communication passage may be set according to, for example, a discharge capacity of the high-pressure fuel pump. Also, for example, by preventing the pressure in the delivery pipe from becoming lower than a saturated vapor pressure at a temperature in the delivery pipe, it is possible to suppress the generation of the vapor. However, because the amount of the fuel that leaks from the fuel injection valve increases as the fuel pressure in the delivery pipe increases, the first predetermined pressure may be set, for example, empirically, taking into account the generation of the vapor and the leakage of the fuel.

In the high-pressure fuel supply apparatus, the discharge valve and the communication passage may be formed integrally with each other. With the above-described configuration, the discharge valve and the communication passage are formed integrally with each other. Therefore, it is possible to save space where the discharge valve and the communication passage are provided.

The discharge valve may include a valve element, and the communication passage may be formed in the valve element.

The high-pressure fuel supply apparatus may further include a relief passage which is provided in parallel with the discharge valve, and which connects the area upstream of the discharge valve to the area downstream of the discharge valve; and a relief valve provided in the relief passage. When the fuel pressure in the delivery pipe is higher than a second predetermined pressure, the relief valve may be opened to allow the fuel to pass through the relief valve only in the direction from the delivery pipe toward the high-pressure fuel pump. The relief valve and the communication passage may be formed integrally with each other.

With the above-described configuration, when the relief valve is provided in the relief passage, the relief valve and the communication passage are formed integrally with each other. Therefore, it is possible to save space where the relief valve and the communication passage are provided.

In the high-pressure fuel supply apparatus, the relief valve may include a valve element, and the communication passage is formed in the valve element.

The discharge valve and the communication passage may be formed separately from each other, and the communication passage may be connected to the high-pressure fuel passage.

In the high-pressure fuel supply apparatus, an orifice may be formed in the communication passage. With the configuration, it is possible to easily adjust the amount of the fuel that flows through the communication passage.

A cross sectional area of the orifice may be set so that when the fuel pressure in the delivery pipe is increased to the target pressure using the high-pressure fuel pump, the amount of the fuel, which does not interfere with the increase in the fuel pressure in the delivery pipe, flows through the orifice.

A cross sectional area of the communication passage may be set so that when the fuel pressure in the delivery pipe is increased to the target pressure using the high-pressure fuel pump, the amount of the fuel, which does not interfere with the increase in the fuel pressure in the delivery pipe, flows through the communication passage.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
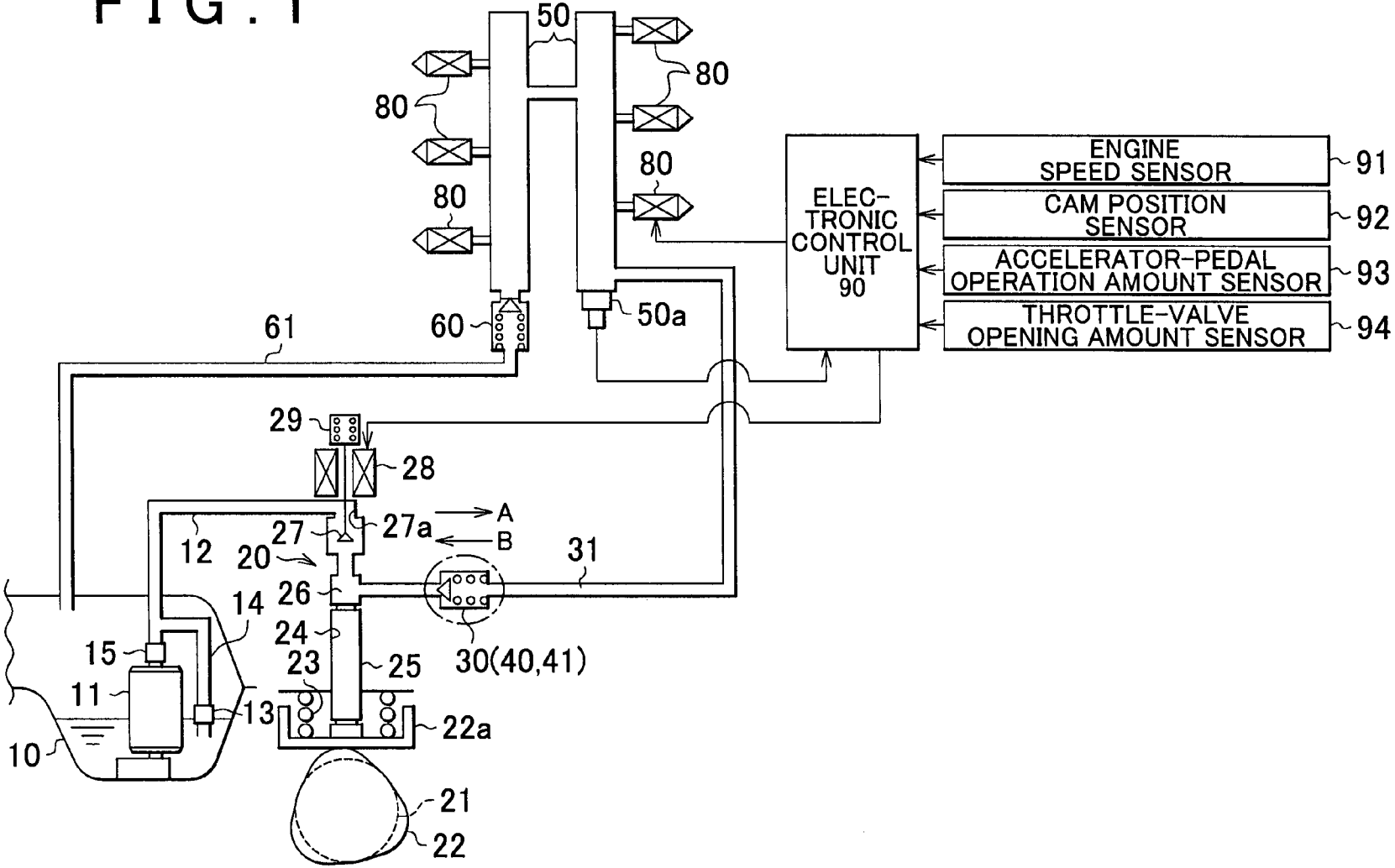
FIG. 1 is a schematic configuration diagram showing a high-pressure fuel supply apparatus for an internal combustion engine according to a first embodiment of the invention, and a peripheral configuration around the high-pressure fuel supply apparatus.

Hereinafter, a high-pressure fuel supply apparatus for an internal combustion engine according to a first embodiment of the invention will be described with reference to FIG. 1 and FIG. 2.

In a fuel tank 10, a low-pressure fuel pump 11 is disposed. The low-pressure fuel pump 11 is connected to a low-pressure fuel passage 12 through a fuel filter 15. The low-pressure fuel passage 12 is connected to each of a high-pressure fuel pump 20 and a return passage 14. An end of the return passage 14 is open in the fuel tank 10. A low-pressure regulator 13 is provided in the return passage 14. The low-pressure regulator 13 maintains a fuel pressure in the low-pressure fuel passage 12 at a set pressure P1. The low-pressure regulator 13 is a pressure-operated valve that is opened when the fuel pressure is higher than the set pressure P1. When the pressure-operated valve is opened, the fuel is returned to the fuel tank 10 through the return passage 14. The set pressure P1 is set based on a discharge capacity of the low-pressure fuel pump 11.

A plunger 25 is housed in a cylinder 24 of the high-pressure fuel pump 20 in a manner such that the plunger 25 reciprocates. A pressurizing chamber 26 is defined by the cylinder 24 and the plunger 25. An end of the plunger 25, which is opposite to the pressurizing chamber 26, is connected to a lifter 22*a*. A coil spring 23 presses the lifter 22*a* toward a cam 22 attached to a camshaft 21 of the internal combustion engine. The pressurizing chamber 26 is connected to the high-pressure fuel passage 31. The plunger 25 reciprocates in the cylinder 24 due to rotation of the cam 22. Thus, an expansion stroke in which the plunger 25 moves to increase size of the pressurizing chamber 26, and a compression stroke in which the plunger 25 moves to decrease the size of the pressurizing chamber 26 are alternately performed.

An electromagnetic spill valve 27 is provided in a connection port 27*a* between the low-pressure fuel passage 12 and the pressurizing chamber 26. The electromagnetic spill valve 27 is pressed by a coil spring 29 to open the connection port 27*a*. When voltage is applied to an electromagnetic solenoid 28, the electromagnetic spill valve 27 is driven to close the connection port 27*a*. When the expansion stroke is performed, that is, the plunger 25 moves to increase the size of the pressurizing chamber 26 while the electromagnetic spill valve 27 opens the connection port 27*a*, the fuel from the low-pressure fuel pump 11 is taken into the pressurizing chamber 26 through the low-pressure fuel passage 12. When the compression stroke is performed, that is, the plunger 25 moves to decrease the size of the pressurizing chamber 26 while the electromagnetic spill valve 27 closes the connection port 27*a*, the fuel in the pressurizing chamber 26 is pressurized and discharged to the high-pressure fuel passage 31.

A discharge valve 30 is provided in the high-pressure fuel passage 31. The high-pressure fuel passage 31 is connected to a delivery pipe 50. Fuel injection valves 80 are connected to the delivery pipe 50. The fuel injection valves 80 inject the fuel to the respective cylinders of the internal combustion engine. The fuel discharged into the high-pressure fuel passage 31 is supplied to the delivery pipe 50 through the discharge valve 30. The fuel supplied to the delivery pipe 50 is stored in the delivery pipe 50, and supplied to the cylinders of the internal combustion engine by the fuel injection valves 80. When the pressure is equal to or higher than a predetermined pressure P0, the discharge valve 30 is opened to allow the fuel to pass through the discharge valve 30 only in a direction from the high-pressure fuel pump 20 to the delivery pipe 50 (i.e., only in the direction indicated by an arrow A). The predetermined pressure P0 is set to a relatively low value.

A relief valve 60 is provided in the delivery pipe 50 to maintain the pressure in the delivery pipe 50 at a value equal to or lower than a set pressure Ph. The relief valve 60 is a pressure-operated valve that is opened when the pressure in the delivery pipe 50 is higher than the set pressure Ph. When the relief valve 60 is opened, the fuel is returned to the fuel tank 10 through a relief passage 61. The set pressure Ph is set to suppress an excessive increase in the fuel pressure in the delivery pipe 50. A fuel pressure sensor 50*a* is fitted to the delivery pipe 50. The fuel pressure sensor 50*a* detects the fuel pressure in the delivery pipe 50, and transmits a signal indicating the fuel pressure to an electronic control unit 90.

Sensors are provided in the internal combustion engine. An engine speed sensor 91 detects an engine speed. A cam position sensor 92 detects a position of the cam 22. An accelerator-pedal operation amount sensor 93 detects an accelerator-pedal operation amount. A throttle-valve opening amount sensor 94 detects an opening amount of a throttle valve that adjusts an intake air amount, and outputs a signal indicating the opening amount of the throttle valve to the electronic control unit 90.

The electronic control unit 90 includes a central processing unit (CPU) and a memory that stores and retains, for example, control programs, calculation maps, and data calculated when a control is executed. The electronic control unit 90 executes, for example, a fuel injection control using the fuel injection valves 80, an ignition timing control using ignition valves, and an intake air amount control using the throttle valve, based on the signals from the sensors.

Also, the electronic control unit 90 controls an amount of the fuel delivered under pressure by the high-pressure fuel pump 20, based on the signal from the fuel pressure sensor 50*a*, and the signals from the sensors. More specifically, the electronic control unit 90 sets a target pressure in the delivery pipe 50 according to the operating state of the vehicle detected based on the signals from the engine speed sensor 91, the accelerator-pedal operation amount sensor 93, the throttle-valve opening amount sensor 94, and the like. Then, the electronic control unit 90 calculates an amount of the fuel required to increase the fuel pressure in the delivery pipe 50 to the target pressure, based on the signal from the fuel pressure sensor 50*a*. In addition, the electronic control unit 90 detects the position of the plunger 25 based on the output from the cam position sensor 92. Further, the electronic control unit 90 supplies electric power to the electromagnetic solenoid 28 to close the electromagnetic spill valve 27 for a predetermined period in the compression stroke of the plunger 25 so that a required amount of the fuel is delivered to the delivery pipe 50.

A communication passage 41 is formed integrally with the discharge valve 30. The communication passage 41 connects an area upstream of the discharge valve 30 to an area downstream of the discharge valve 30. A check valve 40 is provided in the communication passage 41. When the pressure at a side where the delivery pipe 50 is provided is higher than a first predetermined pressure Pa, the check valve 40 is opened to allow the fuel to pass through the check valve 40 only in a direction from the delivery pipe 50 toward the high-pressure fuel pump 20 (i.e., only in a direction indicated by an arrow B).

Next, the configuration of each of the discharge valve 30, the check valve 40, and the communication passage 41 will be described with reference to FIG. 2. The discharge valve 30 includes a cylindrical valve element 32, a spring 33, and a spring support portion 34. The cylindrical valve element 32 interrupts the flow of the fuel in the high-pressure fuel passage 31. The spring 33 presses the valve element 32 in an axial direction of the valve element 32. The spring support portion 34 fixes the valve element 32 and the spring 33 to each other. The spring 33 is provided between a delivery pipe-side wall surface 32*c* of the valve element 32 and a protrusion surface 31*c* of the high-pressure fuel passage 31. The delivery pipe-side wall surface 32*c* is closer to the delivery pipe 50 than an opposite wall surface of the valve element 32 is. The protrusion surface 31*c* is perpendicular to an inner peripheral surface of the high-pressure fuel passage 31. The valve element 32 is pressed against a contact surface 31*a* of the high-pressure fuel passage 31 by a pressing force of the spring 33. The contact surface 31*a* is slightly inclined with respect to the inner peripheral surface of the high-pressure fuel passage 31. Thus, a seat surface 32*a* of the valve element 32 contacts the contact surface 31*a* of the high-pressure fuel passage 31. The seat surface 32*a* is formed at a high-pressure fuel pump-side end portion of the valve element 32, which is closer to the high-pressure fuel pump 20 than an opposite end portion of the valve element 32 is. Thus, the valve element 32 interrupts the flow of the fuel in the high-pressure fuel passage 31.

When the fuel is delivered from the high-pressure fuel pump 20 in the direction indicated by the arrow A at a pressure that exceeds the pressing force of the spring 33, the valve element 32 is pressed by the pressure, and the spring 33 is compressed. In addition, the valve element 32 is moved in the direction indicated by the arrow A, and thus, the discharge valve 30 is opened. When the discharge valve 30 is thus opened, there is a gap between the seat surface 32*a* of the valve element 32 and the contact surface 31*a* of the high-pressure fuel passage 31. Therefore, the fuel is delivered under pressure toward the delivery pipe 50 through the gap, and a fuel passage 31A between an inner peripheral surface 31*b* of the high-pressure fuel passage 31 and an outer peripheral surface 32*b* of the valve element 32. The pressing force of the spring 33 is set so that the spring 33 is compressed when the pressure at the side where the high-pressure fuel pump 20 is provided is equal to or higher than the predetermined pressure P0.

The communication passage 41 is formed in the valve element 32 in the manner described below. Conical surfaces 32*d* and 32*e* are formed on a delivery pipe-side wall 32A of the valve element 32, which is closer to the delivery pipe 50 than an opposite wall of the valve element 32 is. The conical surfaces 32*d* and 32*e* are conically recessed from sides of the wall 32A. An orifice 42 is formed at apexes of the conical surfaces 32*d* and 32*e*. The orifice 42 extends through the wall 32A.

A cylindrical cavity 41*a* is formed in the valve element 32. The check valve 40 is provided in the cavity 41*a*. The cavity 41*a* is connected to the orifice 42. The check valve 40 includes a spherical body 43 that closes a cavity-side end of the orifice 42, which is closer to the cavity 41*a* than an opposite end of the orifice 42 is; a support portion 44 that supports the spherical body 43; and a spring 45 that presses the spherical body 43 toward the orifice 42 through the support portion 44. More specifically, the spring 45 is provided between an end wall portion 32B and the support portion 44. The end wall portion 32B is pressed into a high-pressure fuel pump-side end portion of the valve element 32, which is closer to the high-pressure fuel pump 20 than an opposite end portion of the valve element 32 is. The spherical body 43 is pressed toward the orifice 42 by the pressing force of the spring 45 to interrupt the flow of the fuel through the orifice 42. In the support portion 44, passages 46 are formed to extend through the support portion 44. A passage 47 is formed in the end wall portion 32B of the valve element 32 to extend through the end wall portion 32B. The fuel passage including the orifice 42, the cavity 41*a*, the passages 46, and the passage 47 is regarded as the communication passage 41 that connects the area upstream of the discharge valve 30 to the area downstream of the discharge valve 30. Thus, the communication passage 41 is formed to extend through the valve element 32 of the discharge valve 30. Therefore, the communication passage 41 is formed in parallel with, and integrally with the discharge valve 30.

The pressing force of the spring 45 is set so that the spring 45 is compressed when the pressure at the side where the delivery pipe 50 is provided is higher than a first predetermined pressure Pa. The pressure is uniform in an area of the fuel passage from the spherical body 43 of the check valve 40 to the delivery pipe 50. Therefore, when the pressure at the side where the delivery pipe 50 is provided is higher than the first predetermined pressure Pa, the pressure applied to the spherical body 43 through the orifice 42 is higher than the first predetermined pressure Pa.

Thus, when the pressure at the side where the delivery pipe 50 is provided exceeds the pressing force of the spring 45, the spherical body 43 and the support portion 44 are pressed by the pressure, and the spring 45 is compressed. In addition, the spherical body 43 and the support portion 44 are moved in the direction indicated by the arrow B, and thus, the check valve 40 is opened. As a result, the fuel is returned in the direction from the delivery pipe 50 toward the high-pressure pump 20 (i.e., in the direction indicated by the arrow B) through the orifice 42, the cavity 41*a*, the passages 46, and the passage 47, that is, through the communication passage 41.

The communication passage 41 is formed so that when the fuel pressure in the delivery pipe 50 is increased to the target pressure using the high-pressure fuel pump 20, an amount of the fuel, which does not interfere with the increase in the fuel pressure, flows through the communication passage 41. The amount of the fuel returned toward the high-pressure fuel pump 20 through the communication passage 41 depends on the cross sectional area of the communication passage 41. Because the orifice 42 is formed in the communication passage 41, the amount of the fuel returned toward the high-pressure fuel pump 20 through the communication passage 41 depends on the cross sectional area of the orifice 42. Accordingly, the cross sectional area of the orifice 42 provided in the communication passage 41 may be set according to, for example, a discharge capacity of the high-pressure fuel pump 20.

The first predetermined pressure Pa is set to a value at which an amount of vapor generated in the delivery pipe 50 after the internal combustion engine is stopped is equal to or smaller than a permissible value, and an amount of the fuel that leaks from the fuel injection valves 80 is equal to or smaller than a permissible value. For example, by preventing the pressure in the delivery pipe 50 from becoming lower than a saturated vapor pressure at a temperature in the delivery pipe 50, it is possible to suppress generation of the vapor. However, because the amount of the fuel that leaks from the fuel injection valves 80 increases as the fuel pressure in the delivery pipe 50 increases, the first predetermined pressure Pa may be set, for example, empirically, taking into account the generation of the vapor and the leakage of the fuel.

According to the first embodiment that has been described, the following advantageous effects are obtained. (1) The communication passage 41 is provided in parallel with the discharge valve 30 to connect the area upstream of the discharge valve 30 to the area downstream of the discharge valve 30. When the fuel pressure in the delivery pipe 50 is increased to the target pressure using the high-pressure fuel pump 20, the amount of the fuel, which does not interfere with the increase in the fuel pressure, flows through the communication passage 41. Therefore, it is possible to increase the fuel pressure in the delivery pipe 50 to the target pressure.

Also, because the fuel is not delivered under pressure toward the delivery pipe 50 when the high-pressure fuel pump 20 is not operated, it is possible to decrease the fuel pressure in the delivery pipe 50 by returning the fuel in the direction indicated by the arrow B from the delivery pipe 50 toward the high-pressure fuel pump 20 through the communication passage 41.

(2) The check valve 40 is provided in the communication passage 41. When the fuel pressure in the delivery pipe 50 is higher than the first predetermined pressure Pa, the check valve 40 is opened to allow the fuel to pass through the check valve 40 only in the direction indicated by the arrow B from the delivery pipe 50 toward the high-pressure fuel pump 20. Therefore, it is possible to maintain the fuel pressure in the delivery pipe 50 at the first predetermined pressure Pa. The first predetermined pressure Pa is set to a value at which the amount of the vapor generated in the delivery pipe 50 after the internal combustion engine is stopped is equal to or smaller than the permissible value, and the amount of the fuel that leaks from the fuel injection valves 80 is equal to or smaller than the permissible value. Therefore, it is possible to suppress the leakage of the fuel from the fuel injection valves 80 and the generation of the vapor. Accordingly, it is possible to suppress the deterioration of emissions at an engine start time due to the leakage of the fuel, and to suppress the deterioration of startability due to the generation of the vapor.

(3) Because the discharge valve 30 and the communication passage 41 are formed integrally with each other, it is possible to save space where the discharge valve 30 and the communication passage 41 are provided. (4) Because the orifice 42 is formed in the communication passage 41, it is possible to easily adjust the amount of the fuel that flows through the communication passage 41.

Hereinafter, a high-pressure fuel supply apparatus for an internal combustion engine according to a second embodiment of the invention will be described with reference to FIG. 3 and FIG. 4. The high-pressure fuel supply apparatus for an internal combustion engine according to the second embodiment differs from the high-pressure fuel supply apparatus for an internal combustion engine according to the first embodiment in the following point. That is, while the communication passage 41 is formed integrally with the discharge valve 30 in the first embodiment, a communication passage is formed integrally with a relief valve in the second embodiment. In the second embodiment, portions of the configuration that are the same as those in the first embodiment are denoted by the same reference numerals, and the detailed description thereof will be omitted.

Figure 3:
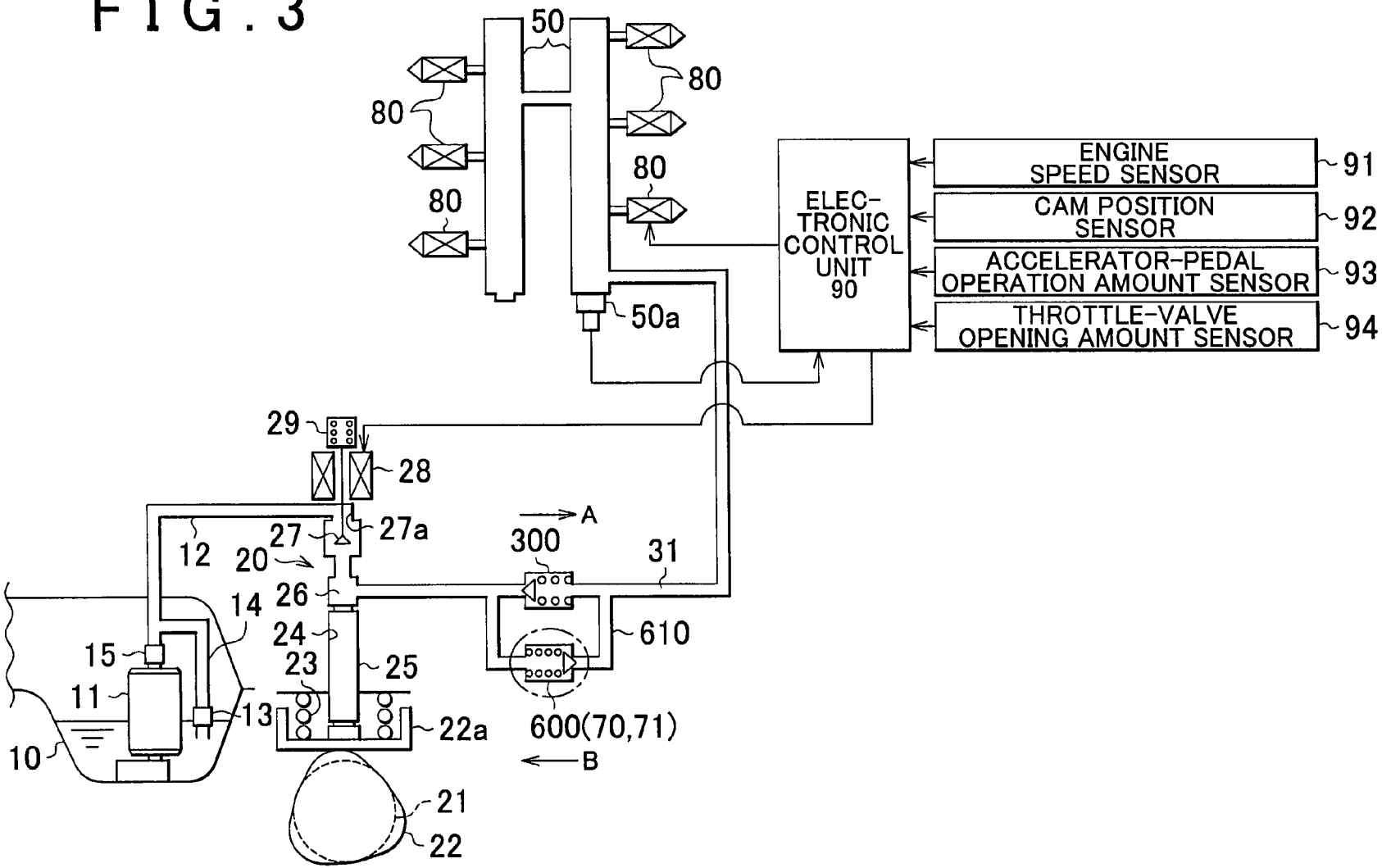
FIG. 3 is a schematic configuration diagram showing a high-pressure fuel supply apparatus for an internal combustion engine according to a second embodiment of the invention, and a peripheral configuration around the high-pressure fuel supply apparatus.

As shown in FIG. 3, a relief passage 610 is connected to the high-pressure fuel passage 31. The relief passage 61 connects an area upstream of a discharge valve 300 to an area downstream of the discharge valve 300. A relief valve 600 is provided in the relief passage 610. When the pressure at the side where the delivery pipe 50 is provided is higher than a second predetermined pressure Pb, the relief valve 600 is opened to allow the fuel to pass through the relief valve 600 only in the direction from the delivery pipe 50 toward the high-pressure fuel pump 20 (i.e., only in the direction indicated by the arrow B). The relief valve 600 is equivalent to the relief valve 60 in the first embodiment. The second predetermined pressure Pb is equivalent to the set pressure Ph for the relief valve 60. That is, the relief valve 600 maintains the fuel pressure in the delivery pipe 50 at a value equal to or lower than the second predetermined pressure Pb. When the fuel pressure in the delivery pipe 50 is higher than the second predetermined pressure Pb, the relief valve 600 allows the fuel to flow out from the delivery pipe 50 through the relief passage 610.

Figure 4:
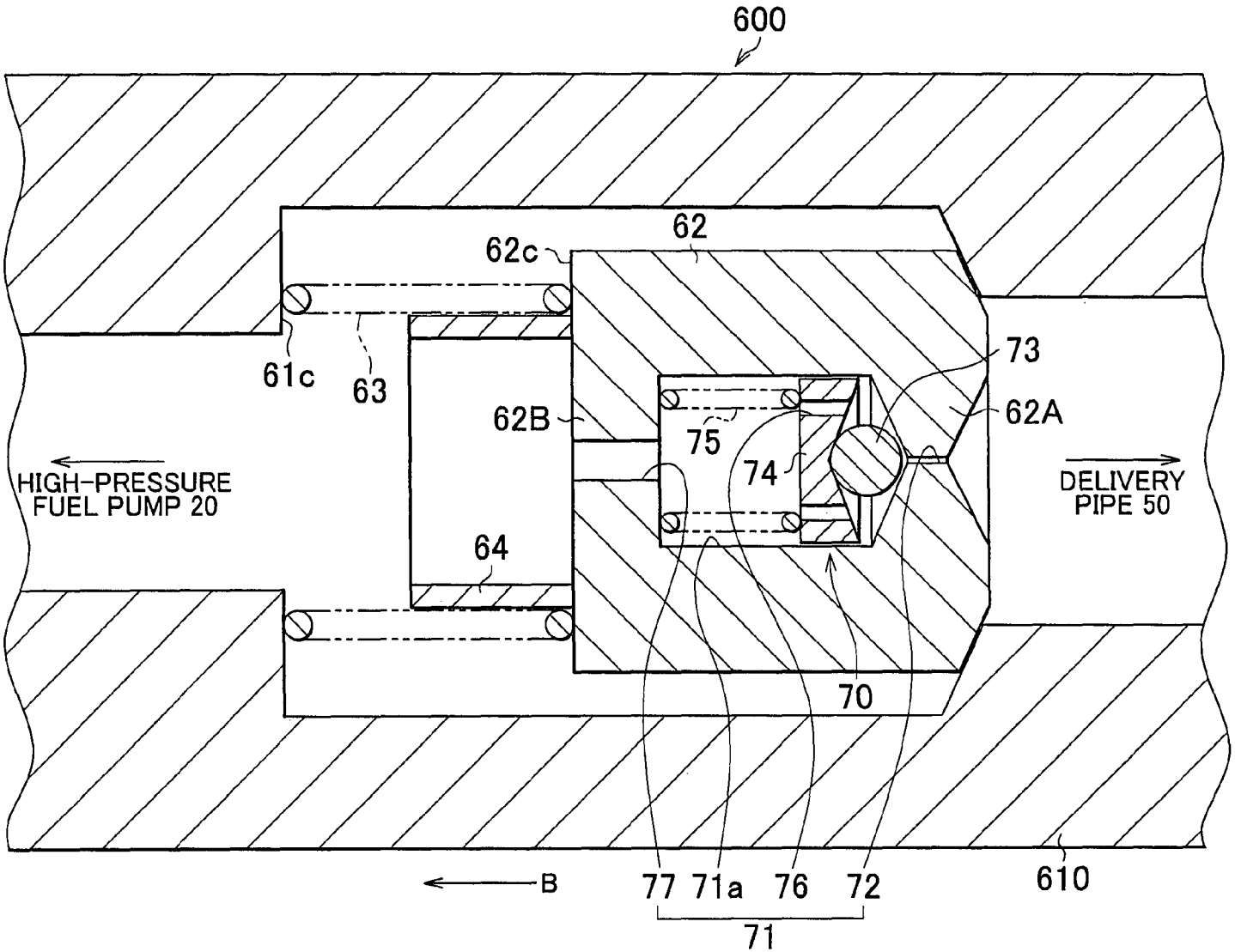
FIG. 4 is a partially enlarged sectional view showing a structure surrounded by a chain line in FIG. 3.

As shown in FIG. 4, the relief valve 600 includes a cylindrical valve element 62, a spring 63, and a spring support portion 64. The cylindrical valve element 62 interrupts the flow of the fuel in the high-pressure fuel passage 610. The spring 63 presses the valve element 62 in the axial direction of the valve element 62. The spring support portion 64 fixes the valve element 62 and the spring 63 to each other. The spring 63 is provided between a high-pressure fuel pump-side wall surface 62*c* of the valve element 62 and a protrusion surface 61*c* of the relief passage 610. The high-pressure fuel pump-side wall surface 62*c* is closer to the high-pressure fuel pump 20 than an opposite wall surface of the valve element 62 is. The protrusion surface 61*c* is perpendicular to an inner peripheral surface of the high-pressure relief passage 610. The valve element 62 is pressed toward the delivery pipe 50 by a pressing force of the spring 63. Thus, the valve element 62 interrupts the flow of the fuel in the relief passage 610.

When the pressure at the side where the delivery pipe 50 is provided exceeds the pressing force of the spring 63, the valve element 62 is pressed by the pressure, and the spring 63 is compressed. In addition, the valve element 62 is moved in the direction indicated by the arrow B, and thus, the relief valve 600 is opened. When the relief valve 600 is thus opened, the fuel flows in the direction from the delivery pipe 50 toward the high-pressure fuel pump 20 (i.e., in the direction indicated by the arrow B). The pressing force of the spring 63 is set so that the spring 63 is compressed and the relief valve 600 is opened when the pressure at the side where the delivery pipe 50 is provided is higher than the second predetermined pressure Pb.

An orifice 72 is formed in a delivery pipe-side wall 62A of the valve element 62, which is closer to the delivery pipe 50 than an opposite wall of the valve element 62. The orifice 72 extends through the delivery pipe-side wall 62A. A cylindrical cavity 71*a* is formed in the valve element 62. A check valve 70 is provided in the cavity 71*a*. The cavity 71*a* is connected to the orifice 72. The check valve 70 has the same function and the same structure as those of the check valve 40 in the first embodiment. That is, the check valve 70 includes a spherical body 73, a support portion 74, and a spring 75. The spherical body 73 is pressed toward the orifice 72 by the pressing force of the spring 75 to interrupt the flow of the fuel through the orifice 72. Passages 76 are formed in the support portion 74 to extend through the support portion 74. A passage 77 is formed in a high-pressure fuel pump-side wall 62B of the valve element 62, which is closer to the high-pressure fuel pump 20 than an opposite wall of the valve element 62 is. The passage 77 extends through the high-pressure fuel pump-side wall 62B. The fuel passage including the orifice 72, the cavity 71*a*, the passages 76, and the passage 77 is regarded as a communication passage 71. That is, the communication passage 71 is provided in parallel with the discharge valve 300 to connect the area upstream of the discharge valve 300 to the area downstream of the discharge valve 300. The cross sectional area of the orifice 72 provided in the communication passage 71 is set so that when the fuel pressure in the delivery pipe 50 is increased to the target pressure using the high-pressure fuel pump 20, an amount of the fuel, which does not interfere with the increase in the fuel pressure, flows through the orifice 72.

When the pressure at the side where the delivery pipe 50 is provided is higher than the first predetermined pressure Pa, the check valve 70 is opened to allow the fuel to pass through the check valve 70 only in the direction from the delivery pipe 50 toward the high-pressure fuel pump 20 (i.e., only in the direction indicated by the arrow B). More specifically, when the pressure at the side where the delivery pipe 50 is provided exceeds the pressing force of the spring 75, the spherical body 73 and the support portion 74 are pressed by the pressure, and the spring 75 is compressed. In addition, the spherical body 73 and the support portion 74 are moved in the direction indicated by the arrow B, and thus, the check valve 70 is opened. Thus, the fuel is returned in the direction from the delivery pipe 50 toward the high-pressure fuel pump 20 (i.e., in the direction indicated by the arrow B) through the orifice 72, the cavity 71*a*, the passages 76, and the passage 77, that is, through the communication passage 71.

According to the second embodiment that has been described, the following advantageous effect (5) is obtained, in addition to advantageous effects similar to the above-described advantageous effects (1), (2), and (4). (5) When the relief valve 600 is provided in the relief passage 610, the relief valve 600 is formed integrally with the communication passage 71. Therefore, it is possible to save space where the relief valve 600 and the communication passage 71 are provided.

The high-pressure fuel supply apparatus for an internal combustion engine according to the invention is not limited to the configurations in the above-described embodiments. Modifications may be appropriately made to the above-described embodiments. For example, the invention may be realized in the following modified embodiments.

In the first embodiment, the communication passage 41 is formed integrally with the discharge valve 30. However, the communication passage may be formed separately from the discharge valve, as long as the communication passage is provided in parallel with the discharge valve to connect the area upstream of the discharge valve to the area downstream of the discharge valve.

Figure 5:
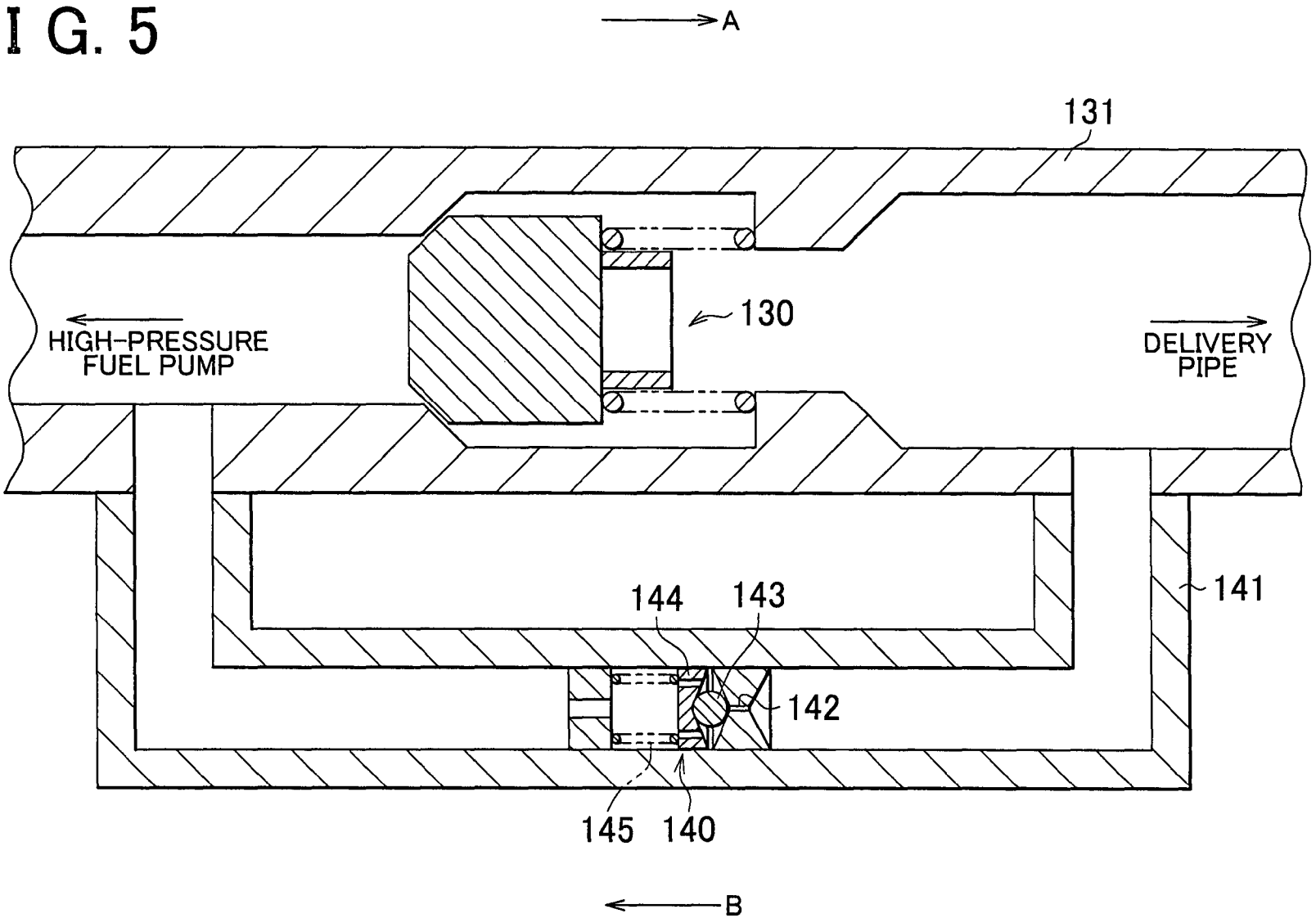
FIG. 5 is a partially enlarged sectional view showing a high-pressure fuel supply apparatus for an internal combustion engine in a modified example of the invention.

For example, a configuration shown in FIG. 5 may be employed. In the configuration shown in FIG. 5, a communication passage 141 is connected to a high-pressure fuel passage 131. The communication passage 141 connects an area upstream of a discharge valve 130 to an area downstream of the discharge valve 130. An orifice 142 is formed in the communication passage 141. A check valve 140 is provided in the communication passage 141. The cross sectional area of the orifice 142 is set so that when the fuel pressure in the delivery pipe is increased to the target pressure using the high-pressure fuel pump, an amount of the fuel, which does not interfere with the increase in the fuel pressure, flows through the orifice 142. When the fuel pressure in the delivery pipe is higher than the first predetermined pressure Pa, the check valve 140 is opened to allow the fuel to pass through the check valve 140 only in the direction from the delivery pipe toward the high-pressure fuel pump. The structure of the check valve 140 is the same as the structure of the check valve 40 in the first embodiment. That is, the check valve 140 includes a spherical body 143, a support portion 144, and a spring 145. In this configuration as well, advantageous effects similar to the advantageous effects (1), (2), and (4) are obtained.

In the communication passage 141 shown in FIG. 5, the orifice 142 need not necessarily be formed. When the orifice 142 is not formed in the communication passage 141, the cross sectional area of the communication passage 141 is decreased so that when the fuel pressure in the delivery pipe is increased to the target pressure using the high-pressure fuel pump, an amount of the fuel, which does not interfere with the increase in the fuel pressure, flows through the communication passage.

In the above-described embodiments, the check valve 40 (70) includes the spherical body 43 (73), the support portion 44 (74), and the spring 45 (75). However, the structure of the check valve is not limited to this structure. The check valve may have any structure, as long as the check valve is opened when a condition relating to the pressure in the delivery pipe is satisfied. For example, it is possible to employ the configuration in which the check valve has the same structure as the structure of the discharge valve 30 or the relief valve 60 to interrupt the flow of the fuel through the communication passage.

The structures of the discharge valve and the relief valve are not limited to the structures in the above-described embodiments, and may be appropriately modified. For example, each of the discharge valve and the relief valve may include a spherical body, and the spherical body may contact a contact portion provided in the inner wall of the corresponding fuel passage to interrupt the flow of the fuel.

In the above-described second embodiment, the relief valve 600 includes the spring 63, and the relief valve 600 is opened when the spring 63 is compressed. However, the structure of the relief valve 600 is not limited to this structure. The relief valve may be an electromagnetically-controlled valve that is controlled based on a signal output from the fuel pressure sensor that detects the pressure in the delivery pipe, and that is opened when the pressure in the delivery pipe is higher than the second predetermined pressure. In this configuration as well, advantageous effects similar to the above-described advantageous effects are obtained by providing the communication passage and the check valve in the relief valve.

In the first embodiment, the communication passage 41 is provided to connect the area upstream of the discharge valve 30 to the area downstream of the discharge valve 30. In the second embodiment, the communication passage 71 is provided to connect the area upstream of the discharge valve 300 to the area downstream of the discharge valve 300. In each of the first embodiment and the second embodiment, the fuel is returned in the direction from the delivery pipe 50 toward the high-pressure fuel pump 20 through the communication passage 41 or 71.

However, the communication passage may be provided together with the check valve at a position other than the positions at which the communication passage 41 and 71 are provided in the above-described embodiments. In this case, the communication passage is connected to the delivery pipe 50. When the fuel pressure in the delivery pipe 50 is increased to the target pressure, an amount of the fuel, which does not interfere with the increase in the fuel pressure, flows through the communication passage. The check valve is provided in the communication passage. When the fuel pressure in the delivery pipe 50 is higher than the first predetermined pressure Pa, the check valve is opened to allow only the fuel that flows out from the delivery pipe 50 to pass through the check valve.

Figure 2:
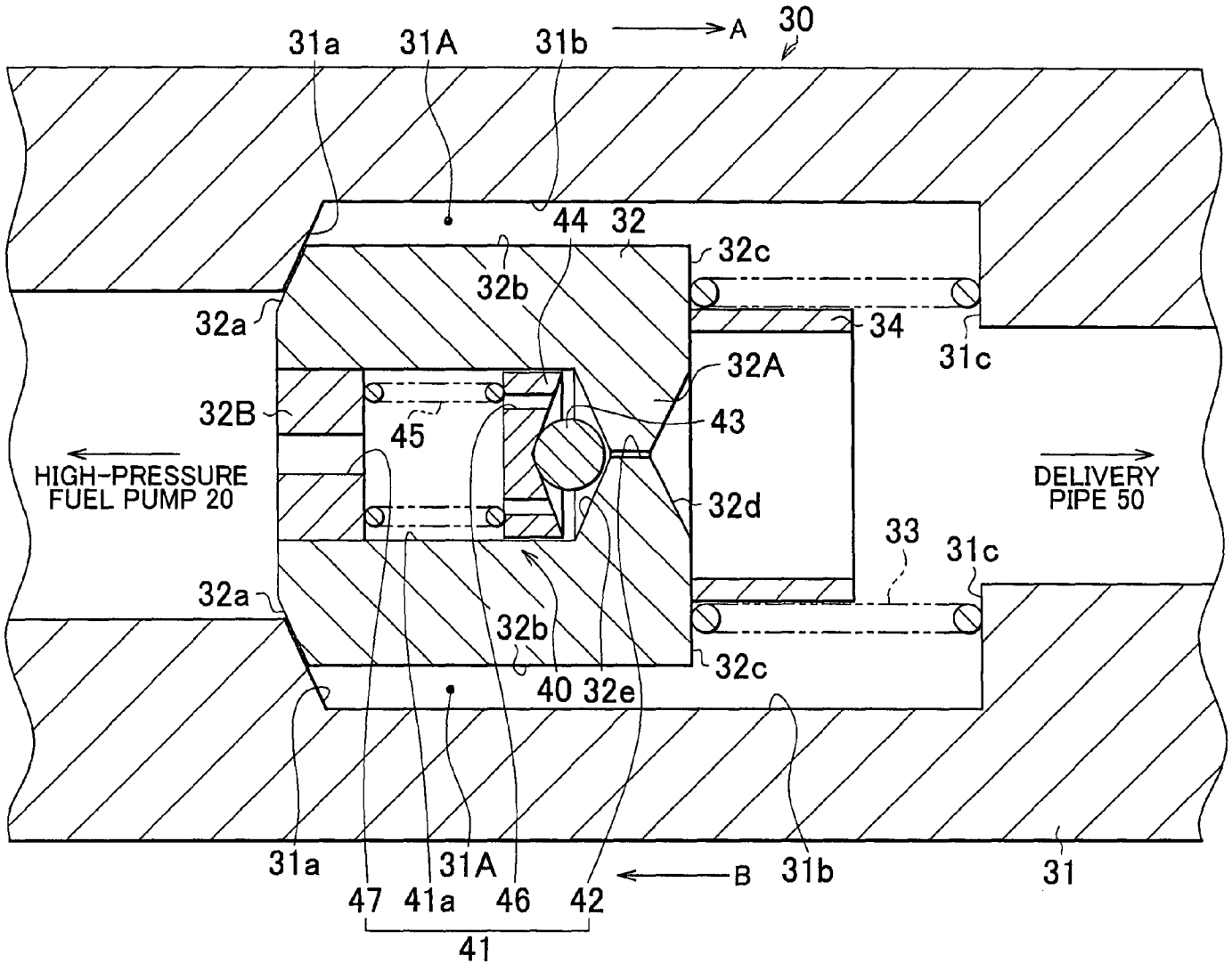
FIG. 2 is a partially enlarged sectional view showing a structure surround by a chain line in FIG. 1.

For example, in the configuration in the first embodiment shown in FIG. 1, the communication passage may be formed integrally with the relief valve 60, or the communication passage connected to the delivery pipe 50 may be formed separately from the relief valve 60. In these configurations as well, the following advantageous effect (6) is obtained by providing the check valve in the communication passage.

(6) The communication passage is connected to the delivery pipe 50. When the fuel pressure in the delivery pipe 50 is increased to the target pressure using the high-pressure pump 20, an amount of the fuel, which does not interfere with the increase in the fuel pressure, flows through the communication passage. Therefore, it is possible to increase the fuel pressure in the delivery pipe 50 to the target pressure. Also, because the fuel is not delivered under pressure toward the delivery pipe 50 when the high-pressure fuel pump 20 is not operated, it is possible to decrease the fuel pressure in the delivery pipe 50 by allowing the fuel to flow out from the delivery pipe 50 through the communication passage.

Also, the check valve is provided in the communication passage. When the fuel pressure in the delivery pipe 50 is higher than the first predetermined pressure Pa, the check valve is opened to allow only the fuel that flows out from the delivery pipe 50 to pass through the check valve. Therefore, it is possible to maintain the fuel pressure in the delivery pipe 50 at the first predetermined pressure Pa. The first predetermined pressure Pa is set to a value at which the amount of the vapor generated in the delivery pipe 50 after the internal combustion engine is stopped is equal to or smaller than a permissible value, and the amount of the fuel that leaks from the fuel injection valves 80 is equal to or smaller than a permissible value. Thus, it is possible to suppress the leakage of the fuel from the fuel injection valves 80 and the generation of the vapor. Accordingly, it is possible to suppress the deterioration of emissions at the engine start time due to the leakage of the fuel, and to suppress the deterioration of the startability due to the generation of the vapor.

In each of the above-described embodiments, the invention is applied to an in-cylinder injection gasoline engine. However, the invention may be applied to a diesel engine.

While the invention has been described with reference to example embodiments thereof, it is to be understood that the invention is not limited to the described embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the spirit and scope of the invention.

The invention claimed is:

1. A high-pressure fuel supply apparatus for an internal combustion engine, comprising:

a high-pressure fuel pump configured to pressurize fuel that is received from a fuel tank by a low-pressure fuel pump;

a delivery pipe to which the fuel pressurized by the high-pressure fuel pump is delivered through a high-pressure fuel passage, and in which the fuel is stored, wherein the fuel stored in the delivery pipe is supplied to a cylinder by a fuel injection valve, and wherein the high-pressure fuel pump pressurizes the fuel to achieve a target pressure in the delivery pipe when the internal combustion engine is operated;

a discharge valve disposed in the high-pressure fuel passage, configured to allow the fuel to pass through the discharge valve only in a direction from the high-pressure fuel pump toward the delivery pipe, a relief passage which is provided in parallel with the discharge valve, and which connects an area upstream of the discharge valve to an area downstream of the discharge valve;

a relief valve, including a valve element, provided in the relief passage, wherein when the fuel pressure in the delivery pipe is higher than a second predetermined pressure that is more than the target pressure, the valve element is opened to allow the fuel to pass through the relief valve only in the direction from the delivery pipe toward the high-pressure fuel pump;

a communication passage provided in parallel with the discharge valve, and inside the valve element of the relief valve;

a check valve provided in the communication passage so as to be contained within the valve element, wherein when the fuel pressure in the delivery pipe is higher than a first predetermined pressure, the check valve is opened to allow only the fuel that flows out from the delivery pipe to pass through the check valve toward the high pressure fuel pump; and the first predetermined pressure is set to a value at which an amount of vapor generated in the delivery pipe after the internal combustion engine is stopped is equal to or smaller than a first permissible value, and an amount of the fuel that leaks from the fuel injection valve after the internal combustion engine is stopped is equal to or smaller than a second permissible value, and wherein the first predetermined pressure is less than the target pressure;

an orifice of the check valve, which is formed in the communication passage, has a cross sectional area set so that:

when the internal combustion engine is being operated, the amount of the fuel that flows through the orifice does not reduce the fuel pressure to below the target pressure in the delivery pipe, and when the internal combustion engine is not being operated, the amount of the fuel that flows through the orifice reduces the fuel pressure to below the first predetermined pressure.

2. The high-pressure fuel supply apparatus according to claim 1, wherein the discharge valve and the communication passage are formed separately from each other, and the communication passage is connected to the high-pressure fuel passage.

3. The high-pressure fuel supply apparatus according to claim 1, wherein the fuel that passes through the relief valve in the direction from the delivery pipe toward the high-pressure fuel pump only flows to the area upstream of the discharge valve.

* * * * *